US006938795B2

(12) United States Patent
Barton, Jr. et al.

(10) Patent No.: US 6,938,795 B2
(45) Date of Patent: Sep. 6, 2005

(54) HAND-HELD FLUID DISPENSER SYSTEM AND METHOD OF OPERATING HAND-HELD FLUID DISPENSER SYSTEMS

(75) Inventors: John D. Barton, Jr., Providence, RI (US); Jeffrey Mendoza, Pascoag, RI (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/887,001

(22) Filed: Jul. 8, 2004

(65) Prior Publication Data

US 2005/0109791 A1 May 26, 2005

Related U.S. Application Data

(60) Provisional application No. 60/525,486, filed on Nov. 26, 2003.

(51) Int. Cl.[7] ..... B67D 5/08

(52) U.S. Cl. ..... 222/1; 222/63; 222/113; 222/333; 222/470; 222/52

(58) Field of Search ..... 222/1, 52, 63, 222/113, 333, 470, 465.1

(56) References Cited

U.S. PATENT DOCUMENTS

| | | | | |
|---|---|---|---|---|
| 3,543,968 A | | 12/1970 | Reighard et al. | 222/146 |
| 3,641,410 A | * | 2/1972 | Vogelsberg | 388/830 |
| 3,971,492 A | | 7/1976 | Lockwood | 222/146 |
| 4,006,845 A | | 2/1977 | Scholl et al. | 222/146 |
| 4,099,653 A | | 7/1978 | Scholl et al. | 222/146 |
| 4,186,851 A | * | 2/1980 | Cantor | 222/113 |
| 4,245,759 A | | 1/1981 | Baker et al. | 222/146 |
| 4,531,287 A | * | 7/1985 | Shibata et al. | 30/43.6 |
| 4,549,243 A | | 10/1985 | Owen et al. | 361/228 |
| 4,814,632 A | | 3/1989 | Glaeser et al. | 307/116 |
| 5,353,468 A | * | 10/1994 | Yap et al. | 15/319 |
| 5,453,644 A | * | 9/1995 | Yap et al. | 307/116 |
| 5,803,313 A | | 9/1998 | Flatt et al. | 222/146.5 |
| 6,206,238 B1 | * | 3/2001 | Ophardt | 222/1 |

(Continued)

FOREIGN PATENT DOCUMENTS

| | | | |
|---|---|---|---|
| GB | 2059513 | 4/1981 | F04B 9/14 |
| WO | WO 03006175 | 1/2003 | B05B 15/00 |

OTHER PUBLICATIONS

International Search Report for Corresponding International Application No. PCT/US2004/039317, Mailing Date: Mar. 4, 2005 (4 pages).

*Primary Examiner*—Kenneth Bomberg
(74) *Attorney, Agent, or Firm*—Wood, Herron & Evans, L.L.P.

(57) ABSTRACT

A hand-held fluid dispenser having an enclosure for supporting a container holding a fluid to be dispensed, and a method of operating such hand-held fluid dispensers. A first proximity sensor is located inside the enclosure immediately adjacent one side of the enclosure, and a second proximity sensor is located inside the enclosure immediately adjacent an opposite side of the enclosure. An actuation circuit is supported inside the enclosure and is electrically connected to the first and second proximity sensors. The actuation circuit produces an actuation signal in response to detecting opposed digits of an operator being simultaneously in close proximity to the first and second proximity sensors.

15 Claims, 4 Drawing Sheets

U.S. PATENT DOCUMENTS 6,279,777 B1 * 8/2001 Goodin et al. ..... 222/52
6,307,182 B1 * 10/2001 Lile ..... 219/257
6,412,662 B1 7/2002 Bryan et al. ..... 222/146.5
6,467,651 B1 * 10/2002 Muderlak et al. ..... 222/52
6,579,563 B1 6/2003 Dillon ..... 427/8
6,792,640 B2 * 9/2004 Lev ..... 15/28
2003/0202851 A1 * 10/2003 Kovarik ..... 408/8
2004/0167675 A1 8/2004 Bednorz et al.

* cited by examiner

HAND-HELD FLUID DISPENSER SYSTEM AND METHOD OF OPERATING HAND-HELD FLUID DISPENSER SYSTEMS

CROSS-REFERENCE TO RELATED APPLICATIONS

This application claims the benefit of U.S. Provisional Application No. 60/525,486 filed on Nov. 26, 2003, the disclosure of which is hereby incorporated by reference herein in its entirety.

FIELD OF THE INVENTION

The present invention generally relates to fluid dispenser systems and more particularly, to hand grip for a fluid dispenser system, fluid dispenser systems using the hand grip, and methods of operating such fluid dispenser systems.

BACKGROUND OF THE INVENTION

Conventional hand grips for fluid dispenser systems have many different shapes and configurations. With some systems, an operator holds a hand grip housing a fluid cartridge or syringe and the dispensing action is initiated with a foot pedal. With other systems, the fluid syringe is mounted in a hand grip grasped by an operator, and a dispensing action is initiated by the operator activating a finger switch on a side of the fluid dispenser. However, all of the known dispensing systems use a mechanical switch of some kind to initiate the dispensing action. Mechanical switches have a poor reputation for reliability of operation over the long term. Furthermore, such mechanical switches must be sealed against environmental contamination from liquids and other materials found in a working environment.

Over an extended period of operation, the requirement of applying a physical force to initiate a dispensing action may be fatiguing and stressful to an operator. Moreover, applying a physical force to initiate a dispensing action often results in the syringe tip being inadvertently moved from a desired dispensing location. In addition, many fluid dispensers are designed simply to hold a syringe without much consideration given to the comfort of the operator in holding the hand grip and operating the fluid dispenser system.

Therefore, there is a need for a hand grip for a fluid dispenser system and methods of operation a fluid dispenser system that lack the disadvantages described above and other disadvantages.

SUMMARY OF THE INVENTION

The invention provides an improved hand grip for a fluid dispenser system that encourages a neutral hand position when using the holder, thus making the holder more comfortable for the operator. Further, the hand grip does not require the application of a physical force to a mechanical switch actuate the fluid dispenser system, thereby reducing fatigue and stress for the operator. This also eliminates the tendency for an operator to move a nozzle tip of the fluid dispenser system when the physical force is applied, which improves dispensing accuracy. In addition, the hand grip is ergonomically designed to comfortably fit a wide range of hand sizes. Further still, the hand grip does not rely on mechanical switches to actuate the dispensing system, thereby improving its reliability because the proximity switches of the invention lack moving components and cannot be contaminated by dispensed fluid. Thus, the hand grip is comfortable to hold, easy to use, very reliable, less fatiguing and stressful than conventional hand grips, and is especially useful in those applications for fluid dispenser systems where dispensing accuracy and precision are important.

In accordance with an embodiment of the invention, a hand grip for a fluid dispenser system includes an enclosure adapted to be held by an operator. The enclosure may be further adapted to support a container containing a fluid to be dispensed. Disposed inside the enclosure are first and second proximity sensors. An actuation circuit, which is supported inside the enclosure, is electrically connected to the first proximity sensor and the second proximity sensor. The actuation circuit produces an actuation signal in response to sensing one digit of the operator near the first proximity sensor and another digit of the operator near the second proximity sensor effective to cause a fluid dispenser system to dispense an amount of the fluid.

In another aspect of the invention, a method of dispensing a fluid includes sensing a proximity of a first digit of an operator to a hand grip of a fluid dispenser system. The method further includes sensing a proximity of a second digit of the operator to the hand grip and causing the fluid dispenser system to dispense the amount of the fluid in response to simultaneously sensing the proximity of the first digit to the hand grip and the proximity of the second digit to the hand grip.

These and other objects and advantages of the present invention will become more readily apparent during the following detailed description together with the drawings herein.

DETAILED DESCRIPTION

Figure 1:
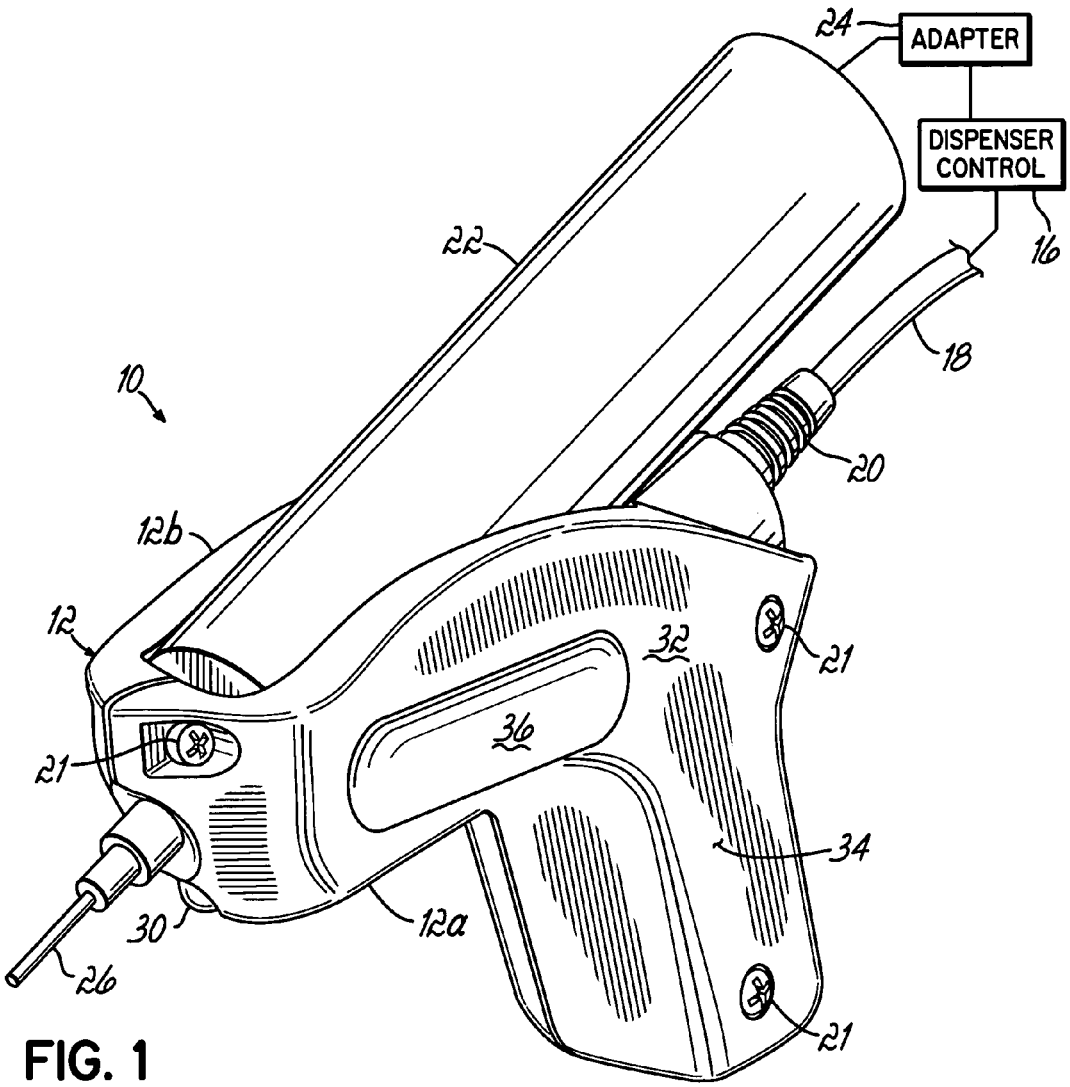
FIG. 1 is a perspective view of a fluid dispenser system in accordance with the invention.
Figure 2:
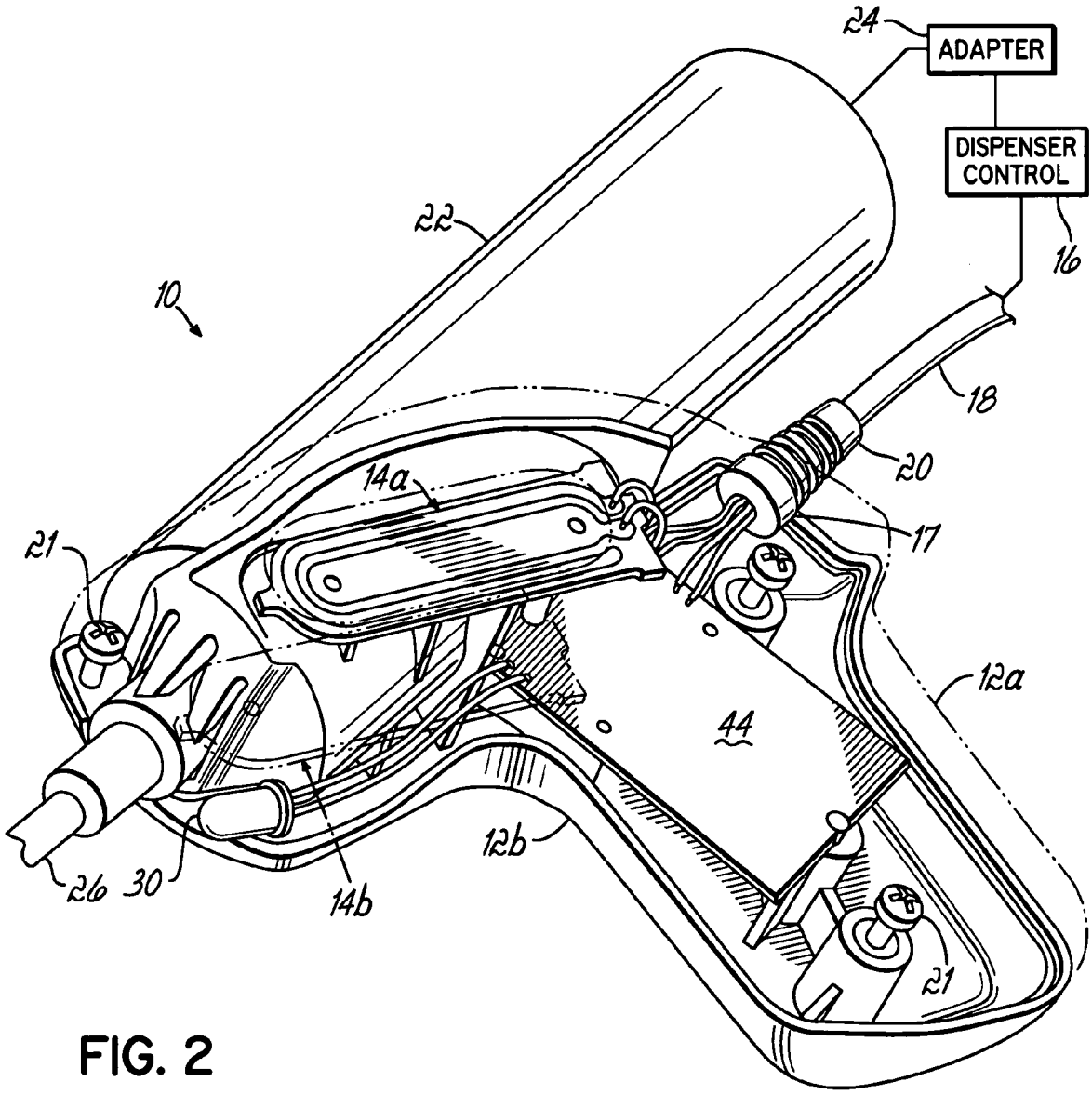
FIG. 2 is a perspective view illustrating the internal construction of the hand grip of the fluid dispenser system of FIG. 1.
Figure 4:
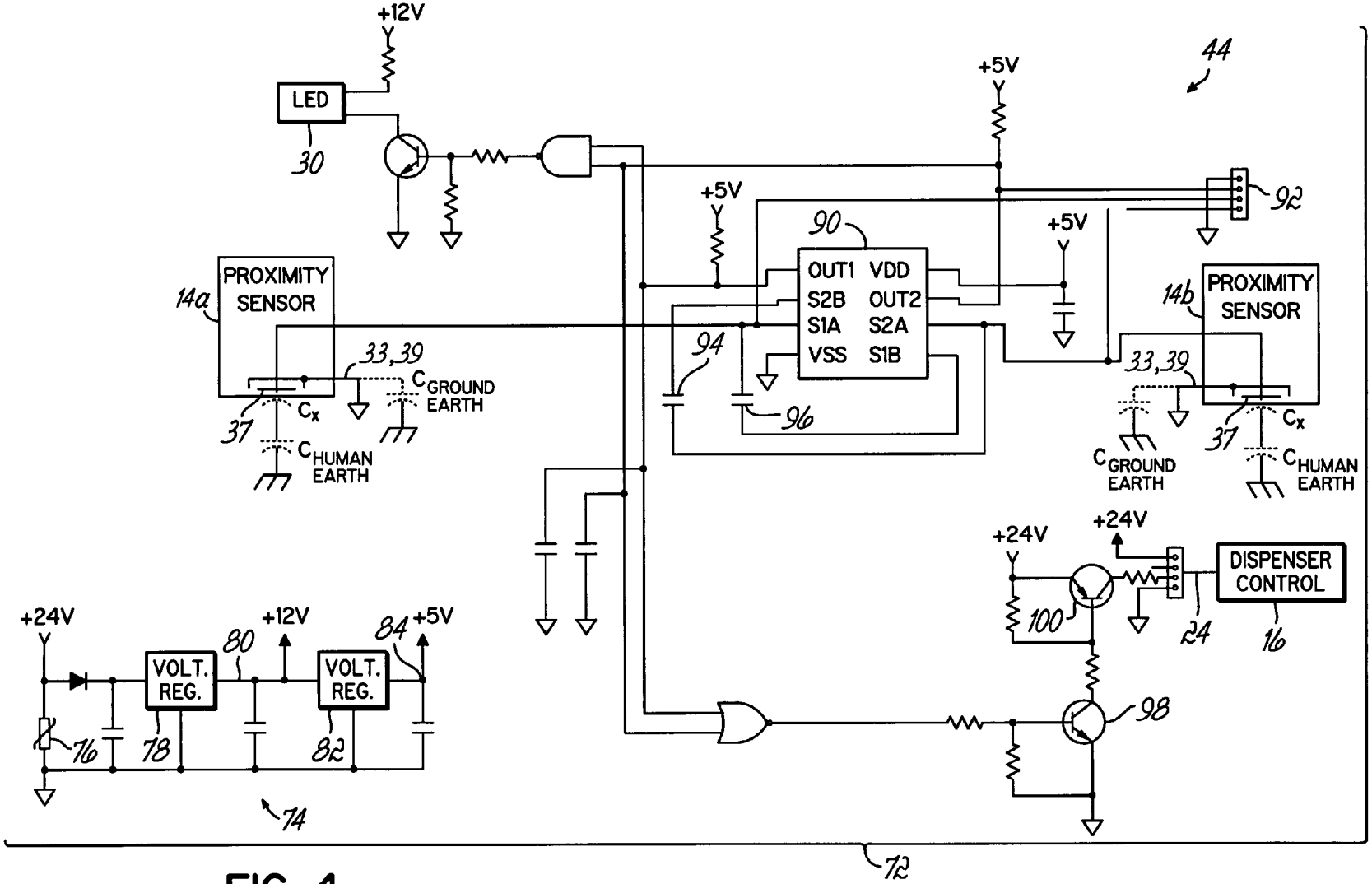
FIG. 4 is a schematic diagram of a control circuit located inside the hand grip of the fluid dispenser of FIG. 1.

Referring to FIGS. 1 and 2, a hand grip 10 for use with a fluid dispenser system has an enclosure 12 that sealingly encloses a pair of proximity sensors or switches 14*a*, 14*b* and an actuation control 72 (FIG. 4). The actuation control 72 is electrically connected to a dispenser control 16 of the fluid dispenser system via a cable 18 to define the fluid dispenser system. An exemplary dispenser control 16 with which the hand grip 10 may be electrically connected is the family of Ultra™ 2400 Series Dispensing Workstations commercially available from EFD Inc., East Providence, R.I. The point of egress 17 (FIG. 2) of the cable 18 from the enclosure 12 is designed to prevent entanglement with the workpiece intended to receive dispensed fluid and includes an integral overmolded strain relief 20. The enclosure 12 is comprised of two opposing pieces 12*a*, 12*b* assembled together with conventional fasteners 21.

The enclosure 12 supports a fluid container, illustrated as a syringe 22, held in place in a known manner by a friction clip, which retains a common outer diameter feature on each of the different syringe sizes. Syringe 22 contains a fluid to be dispensed and may hold a volume of the fluid in a range of about three (3) cubic centimeters to about fifty (50) cubic centimeters. Alternatively, the fluid container supported by enclosure 12 may be any syringe barrel, cartridge or other structure capable of containing fluid to be dispensed and physically shaped to be held by enclosure 12. In other alternative embodiments, the hand grip 10 may not support a fluid container but, instead, the dispensed fluid may originate from a remote fluid supply and the hand grip 10 may merely include a dispensing tip for dispensing the fluid supplied from the remote fluid supply.

Figure 6:
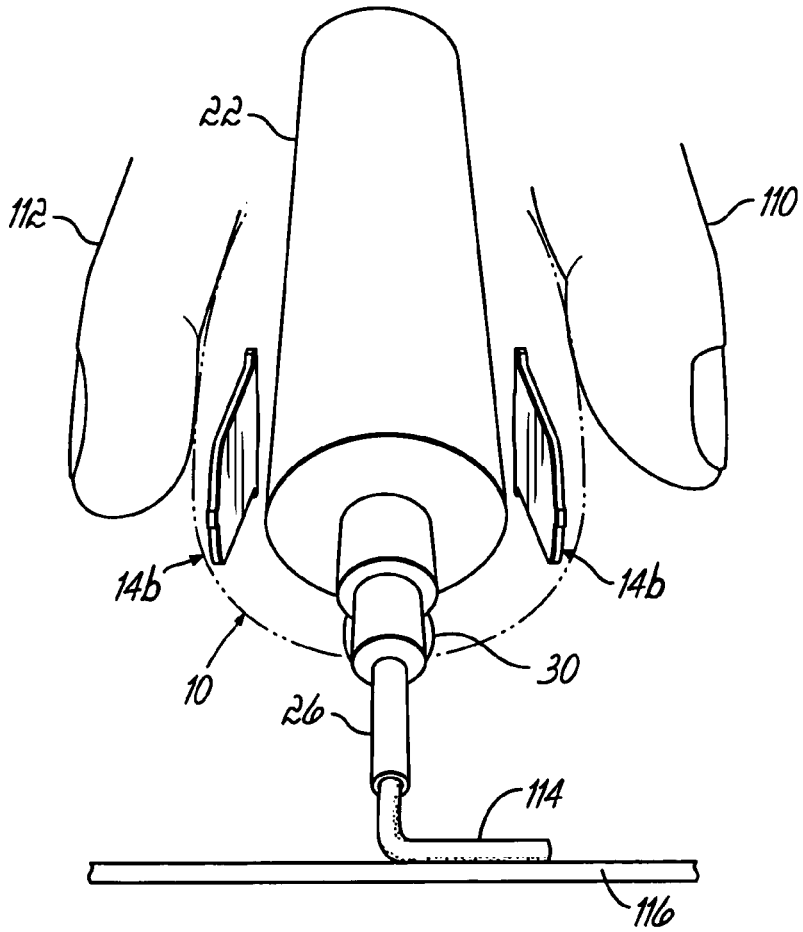

An adaptor 24 is coupled with the open end of syringe 22 to define a sealed space between the adaptor 24 and a piston inside the syringe 22. The adaptor 24 is also electrically connected to the dispenser control 16. In a known manner, the dispenser control 16 provides a timed pulse of pressurized air through the adaptor 24 to the sealed space, which causes movement of the piston inside syringe 22 that forces amounts of the fluid confined in the syringe 22 out of a dispensing tip 26. The dispensing tip 26 conveys the fluid from the syringe 22 to a workpiece, as shown in FIG. 6, and is available in a wide variety of known configurations for various dispensing applications.

The hand grip 10 includes a lamp 30, which may be a white LED selected for long life and high efficiency. The lamp 30 is oriented and positioned by mounting features in the enclosure 12 so that the light output of lamp 30 is directed toward, and illuminates, the dispensing tip 26 and/or any nearby dispensing point for improving visualization of the dispensing point and control over dispensing. The lamp 30 is capable of effectively illuminating workpieces having surface characteristics that present a wide variety of dispensing points.

The enclosure 12 has a body portion 32 and a grip portion 34 extending generally at a right angle from the body portion 32. The grip portion 34 is adapted to be grasped and manipulated by one hand of an operator. The grip portion 34 is dimensioned and designed to provide a comfortable grip for a wide variety of operator hand sizes and prevent unnecessary palm compression. The length of the grip portion 34 is designed to be long enough to be comfortably held by an operator with larger hands but short enough to prevent interference with the workpiece surface when used by an operator with smaller hands.

A pair of opposed, longitudinally-aligned recesses 36, of which only one recess 36 is visible in FIG. 1, are located on respective opposite sides of the body portion 32. As shown in FIG. 2, one of the pair of proximity switches 14*a*, 14*b* is located immediately adjacent an inner side of each of the recesses 36. The recesses 36 allow the operator to locate the active area of the proximity switches 14*a*, 14*b* without having to look at the hand grip 10. The enclosure 12 seals the proximity switches 14*a*, 14*b* from fluid contamination.

The recesses 36 are designed to receive opposed digits, for example, a thumb and forefinger, of an operator gripping the grip portion 34, as described below. The recesses 36 are dimensioned and designed to accommodate a wide variety of operator hand sizes and to accommodate differences in operator hand dominance (i.e., right or left). The body portion 32 has a width sized to encourage a neutral pincer position by the operator.

The two proximity switches 14*a*, 14*b* are connected to an electronic printed circuit ("PC") board 44 that contains the actuation control circuitry shown in FIG. 4. The printed circuit board 44 and proximity switches 14*a*, 14*b* are held in place by mounting pins and bosses that are molded into the enclosure 12. Openings 54 in proximity switches 14*a*, 14*b* provide access to mounting pins for securing the proximity switches 14*a*, 14*b* in hand grip 10.

Figure 3A:
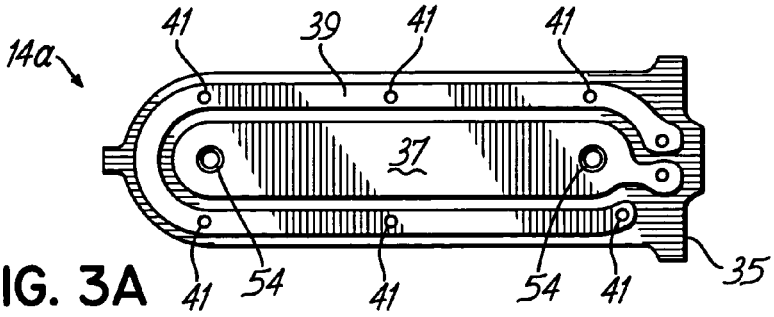
FIG. 3A is an elevational view of an outwardly-directed side of a proximity switch used in the hand grip of the fluid dispenser of FIG. 1.
Figure 3B:
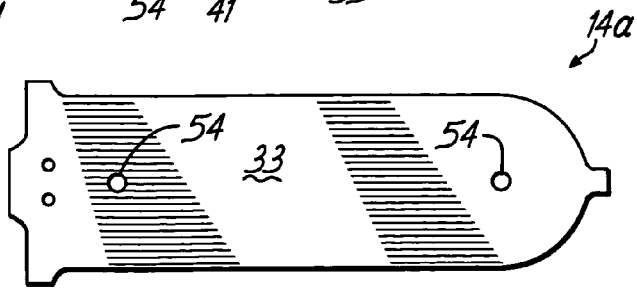
FIG. 3B is an elevational view of an inwardly-directed side of a proximity switch used in the hand grip of the fluid dispenser of FIG. 1.

With reference to FIGS. 3A and 3B, proximity switch 14*a*, which is identical to proximity switch 14*b*, is formed by a double-sided PC board 35. An outwardly-directed side of each PC board 35 has a shaped sensor electrode 37 with a geometry designed to be most sensitive in the area overlapping a respective one of the recesses 36. An outer side guard loop 39 is connected by vias 41 to an inner side guard plane 33 (FIG. 3B) that extends over a substantial area of an opposite, inwardly-directed side of each PC board 35. The inner side guard plane 33 acts as an electrical guard and decreases inner side sensitivity to potential false triggers, for example, from the presence of fluid in the syringe 22 or a non-adjacent digit. Thus, each of the proximity switches 14*a*, 14*b* is sensitive on only its outer side. In the assembled hand grip 10, the guard plane 33 of proximity switch 14*a* confronts the guard plane 33 of proximity switch 14*b*. Because the proximity switches 14*a*, 14*b* have no moving parts, field failures and other reliability concerns are reduced.

As used in this description, terms such as "outboard," "outer" and "outward" indicate a direction or orientation away from or farther from a longitudinal centerline of the hand grip 10. Conversely, "inboard," "inner" and "inward" indicate a direction or orientation toward or closer to the longitudinal centerline.

Referring to FIG. 4, the actuator control 72 includes a power supply 74 that receives twenty-four (24) volts from the dispenser control 16 via the cable 18. An input varistor 76 functions as a surge suppressor that protects the devices in the actuator control 72 from noise induced over-voltage conditions. A first voltage regulator 78 provides a twelve (12) volt output 80 and a second voltage regulator 82 provides a five (5) volt output 84. A dual touch switch controller 90 operates on a charge transfer principle and senses a presence of an operator's finger by measuring a change of capacitance of the sense electrode 37 to earth. The controller 90 is able to discriminate very small changes in capacitance, for example, in the femtofarad range, in the presence of much larger background capacitances. The human body naturally has several hundred picofarads of intrinsic parasitic capacitance (FIG. 4) to earth and a local supply ground (FIG. 4) also has parasitic capacitance to earth.

Various chip parameters of the controller 90, for example, sensitivity, frequencies, digital filtering, etc., can be programmed into a nonvolatile memory of the controller 90 utilizing a connector 92. The controller 90 detects changes in capacitance between the shaped sense electrode 37 (FIG. 3) of a corresponding one of the proximity switches 14*a*, 14*b* and another plate consisting of an operator's finger in conjunction with background capacitance to earth. The changes in capacitance are sensed through a thickness of the material, typically plastic, forming the enclosure 12 at the location of the recesses 36. The controller 90 may be implemented using commercially available integrated circuits, for example, programmable sensor integrated circuit Part No. QT320IS commercially available from Quantum Research Group of Pittsburgh, Pa. that is equipped with two sensing channels.

Thus, each of the proximity switches 14*a*, 14*b* functions as one plate of an unknown capacitance to earth, which increases when an operator brings a digit in closer proximity to a respective recess 36 adjacent the corresponding one of the proximity switches 14*a*, 14*b*. As the operator moves the digit closer to the respective recess 36, the change in capacitance detected by the controller 90 is sufficient to cause the controller 90 to change states. The sensitivity of the controller 90, which represents the distance between each of the proximity switches 14*a*, 14*b* and a corresponding one of the operator's digits that creates a change of capacitance causing the controller 90 to switch states, is adjustable. The sensitivity can be adjusted by varying capacitors 94, 96 and/or by varying programmable chip parameters via the connector 92 as previously described. Thus, the sensitivity can be adjusted to accommodate the unique requirements of a particular dispensing application. However, it is important to note that actuation of the proximity switches 14*a*, 14*b* occurs without the operator applying a physical force to the hand grip 10.

Figure 5:
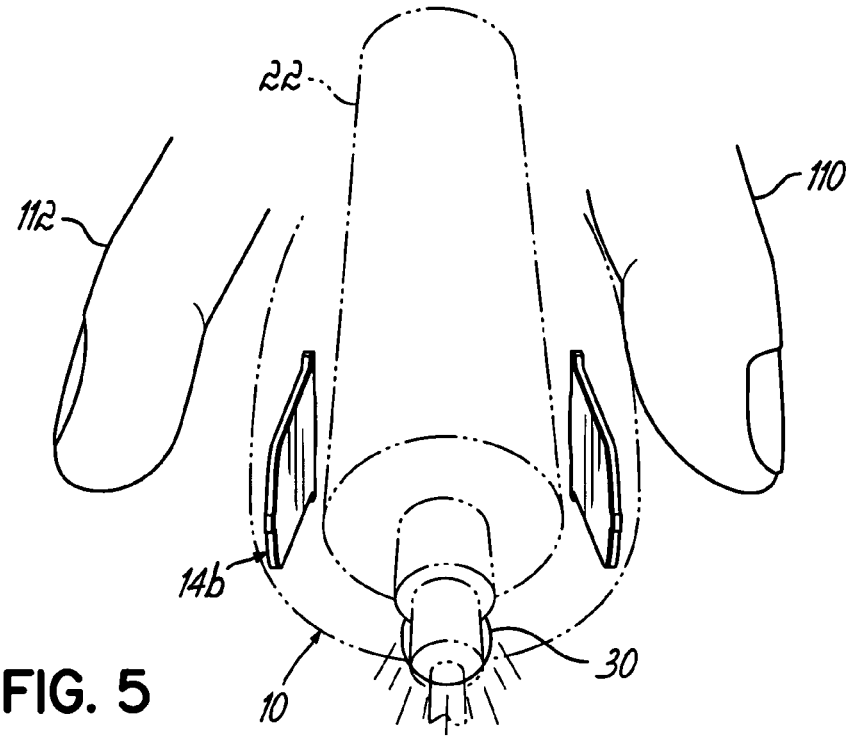
FIGS. 5 and 6 are diagrammatic views illustrating the operation of the fluid dispenser of FIG. 1.

In use and with reference to FIGS. 5 and 6, upon picking up the hand grip 10, the operator moves a digit 110, for example, a thumb, in the proximity of or against, if desired, a recess 36 adjacent a first proximity switch 14*a*. As the thumb 110 moves closer to the proximity switch 14*a*, the controller 90 (FIG. 4) senses or detects a change of capacitance and provides a first output signal causing the lamp 30 to illuminate. The hand grip 10 is thus armed to dispense an amount of fluid from the syringe 22. That illumination provides an indication to the operator of a switch closure and further provides assistance to the operator in locating the dispensing tip 26 at a desired position. When that position is achieved, the operator simply moves another digit 112, for example, a forefinger, toward the recess 36 adjacent the second proximity switch 14*b*. As the forefinger 112 moves closer to the proximity switch 14*b*, the controller 90 senses or detects a change of capacitance and provides a second output signal. The simultaneous occurrence of both the first and the second output signals causes transistors 98 and 100 to change state, thereby changing the state of an actuation signal provided from the actuation control 72 via the cable 18 to the dispenser control 16. The dispenser control 16 then detects the change of state of the actuation signal. This triggers the dispenser control 16 to operate the adaptor 24 (FIG. 1) in a known manner to provide a pulse of air to the syringe 22 and dispense an amount 114 of the fluid onto a substrate 116.

In an alternative technique of operation, the forefinger 112 may be used to trigger the second proximity switch 14*b* before the first proximity switch 14*a* is triggered. In that event, the lamp 30 is illuminated indicating a switch closure; and an actuation signal is produced after the thumb 110 is used to trigger first proximity switch 14*a*.

In summary, the lamp 30 may be illuminated in response to the controller 90 detecting a proximity of an operator's digit 110, 112 to either one of the proximity switches 14*a*, 14*b*, depending upon the technique used to cause dispensing. In addition, the controller 90 provides an actuation signal to the dispenser control 16 in response to detecting a simultaneous proximity of the operators digits 110, 112 to both of the proximity switches 14*a*, 14*b*.

In yet another alterative embodiment of the invention, the lamp 30 may be continuously lit, and the switch closure indicative of the proximity of an operator's digit 110, 112 near either of the proximity switches 14*a*, 14*b* may be indicated in a different manner as understood by a person of ordinary skill in the art. In yet other alternative embodiments, the lamp 30 may be omitted such that the presence of the first digit near either one of the proximity switches 14*a*, 14*b* arms the hand grip 10 for operation, either with or without an alternative indication to the operator, and the proximity of the second digit 112 to the other of the proximity switches 14*a*, 14*b* causes fluid to be dispensed. In yet other embodiments of the invention, controller 90 may communicate with the dispenser control 16 when the proximity of the first digit 110 near proximity switch 14*a* is sensed.

The ergonomic design of the enclosure 12 encourages a neutral hand position when using the hand grip 10, thus making the hand grip 10 more comfortable for the operator. Further, it is not required that the operator bend digits 110, 112 or apply a force against the hand grip 10 to actuate the proximity switches 14*a*, 14*b*. The proximity switches 14*a*, 14*b* are actuated by the operator's digits 110, 112 being close or proximate to the recesses 36, which is an action that does not disturb the position of the dispensing tip 26. In addition, the ergonomic design of the enclosure 12 comfortably fits a wide range of hand sizes, and lamp 30 illuminates the dispensing tip 26. Thus, the hand grip 10 is comfortable to hold, easy to use, very reliable, less fatiguing and stressful than conventional hand-held fluid dispensers, and is especially useful in those applications where dispensing accuracy and precision are important.

While the invention has been illustrated by the description of one embodiment and while the embodiment has been described in considerable detail, there is no intention to restrict or in any way limit the scope of the appended claims to such detail. Additional advantages and modifications will readily appear to those who are skilled in the art. Therefore, the invention in its broadest aspects is not limited to the specific details shown and described. Consequently, departures may be made from the details described herein without departing from the spirit and scope of the claims that follow.

What is claimed is:

1. A hand grip for an operator of a fluid dispenser system used to dispense a fluid, comprising:

an enclosure adapted to be held by the operator;

a first proximity sensor disposed inside said enclosure;

a second proximity sensor disposed inside said enclosure; and an actuation circuit supported inside said enclosure and electrically connected to said first proximity sensor and to said second proximity sensor, said actuation circuit producing an actuation signal in response to sensing a first digit of the operator near said first proximity sensor and a second digit of the operator near said second proximity sensor that is effective to cause the fluid dispenser system to dispense an amount of the fluid.

2. The fluid dispenser of claim 1 wherein said enclosure further comprises a lamp electrically coupled with said actuation circuit, said lamp being powered by said actuation circuit in response to detecting the first digit proximate to said first proximity sensor.

3. The fluid dispenser of claim 1 wherein said enclosure includes a body portion and a grip portion extending from said body portion, said body portion has a first side and a second side opposite said first side, and said grip portion is adapted to be grasped by the operator.

4. The fluid dispenser of claim 3 wherein a first recess and said second recess are each shaped to receive one of the first and second digits of the operator.

5. The fluid dispenser of claim 3 wherein said first side of said body portion includes a first recess separated by a first area of said body portion from said first proximity sensor and said second side of said body portion includes a second recess separated by a second area of said body portion from said second proximity sensor.

6. The fluid dispenser of claim 5 wherein said first proximity sensor is disposed inside said enclosure adjacent said first side of said enclosure and proximate to said first recess, and said second proximity sensor is disposed inside said enclosure adjacent said second side of said enclosure and proximate to said second recess.

7. The fluid dispenser of claim 6 wherein said first proximity sensor includes an electrode facing toward said first recess and said second proximity sensor includes an electrode facing toward said second recess.

8. The fluid dispenser of claim 1 wherein said enclosure is further adapted to support a container holding the fluid to be dispensed.

9. A method of operating a fluid dispenser system for dispensing a fluid from a hand grip of the fluid dispenser system held by an operator, comprising:

sensing a proximity of a first digit of the operator to the hang grip;

sensing a proximity of a second digit of the operator to the hand grip; and causing the fluid dispenser system to dispense the amount of the fluid in response to simultaneously sensing the proximity of the first digit to the hand grip and the proximity of the second digit to the hand grip.

10. The method of claim 9 wherein sensing the proximity of the first digit occurs before sensing the proximity of the second digit.

11. The method of claim 9 wherein sensing the proximity of the second digit occurs before sensing the proximity of the first digit.

12. The method of claim 9 further comprising:

energizing a lamp carried by the fluid dispenser in response to sensing the proximity of the first digit.

13. The method of claim 9 wherein sensing the proximity of the first digit further comprises:

sensing the proximity of the first digit with the first digit separated from the fluid dispenser in a non-contacting relationship.

14. The method of claim 9 wherein sensing the proximity of the second digit further comprises:

sensing the proximity of the second digit with the second digit separated from the fluid dispenser in a non-contacting relationship.

15. The method of claim 9 wherein the hand grip carries a container holding a reservoir of the fluid, and causing the fluid dispenser system to dispense the amount of the fluid further comprises:

producing an actuation signal in response to detecting the first digit of the operator near said first proximity sensor and a second digit of the operator near said second proximity sensor; and transmitting the actuation signal to the fluid dispenser system that is effective to cause the fluid dispenser system to dispense the amount of the fluid from the container.

* * * * *

UNITED STATES PATENT AND TRADEMARK OFFICE

CERTIFICATE OF CORRECTION

PATENT NO. : 6,938,795 B2
APPLICATION NO. : 10/887001
DATED : September 6, 2005
INVENTOR(S) : John D. Barton, Jr. et al.

It is certified that error appears in the above-identified patent and that said Letters Patent is hereby corrected as shown below:

IN THE SPECIFICATION:

Column 1, line 46, change "operation" to insert --operating --.

Column 1, line 56, insert the word "to" after the word --switch--.

Column 5, line 60, change "operators" to --operator's--.

Column 5, line 62, change "alterative" to --alternative--.

IN THE CLAIMS:

Column 6, line 52, change "fluid dispenser" to ---hand grip--.

Column 6, line 57, change "fluid dispenser" to ---hand grip--.

Column 6, line 62, change "fluid dispenser" to ---hand grip--.

Column 6, line 65, change "fluid dispenser" to ---hand grip--.

Column 7, line 4, change "fluid dispenser" to ---hand grip--.

UNITED STATES PATENT AND TRADEMARK OFFICE

CERTIFICATE OF CORRECTION

PATENT NO. : 6,938,795 B2
APPLICATION NO. : 10/887001
DATED : September 6, 2005
INVENTOR(S) : John D. Barton, Jr. et al.

It is certified that error appears in the above-identified patent and that said Letters Patent is hereby corrected as shown below:

Column 7, line 10, change "fluid dispenser" to ---hand grip--.

Column 7, line 14, change "fluid dispenser" to ---hand grip--.

Column 8, line 5, change "fluid dispenser" to ---hand grip--.

Column 8, line 10, change "fluid dispenser" to ---hand grip--.

Column 8, line 15, change "fluid dispenser" to ---hand grip--.

Signed and Sealed this

Twelfth Day of September, 2006

JON W. DUDAS
*Director of the United States Patent and Trademark Office*